US005162625A

United States Patent [19]

Comerford

[11] Patent Number: 5,162,625

[45] Date of Patent: Nov. 10, 1992

[54] SWITCH ASSEMBLY

[75] Inventor: John Comerford, Glendale Heights, Ill.

[73] Assignee: Eaton Corporation, Cleveland, Ohio

[21] Appl. No.: 644,135

[22] Filed: Jan. 22, 1991

[51] Int. Cl.[5] ..... H01H 3/16

[52] U.S. Cl. ..... 200/61.89

[58] Field of Search ..... 200/61.89, 61.9, 61.81, 200/1 A, 86.5

[56] References Cited

U.S. PATENT DOCUMENTS

| | | | |
|---|---|---|---|
| 1,919,206 | 7/1933 | Douglas | 200/61.89 X |
| 3,866,008 | 2/1975 | Teruzzi | 200/303 |
| 4,227,060 | 10/1980 | Ayres et al. | 200/296 |
| 4,239,947 | 12/1980 | Breitung et al. | 200/61.89 |
| 4,316,065 | 2/1982 | Rupp et al. | 200/61.89 |
| 4,384,176 | 5/1983 | Chestnut | 200/1 A |
| 4,853,502 | 8/1989 | Canipe | 200/61.89 |
| 5,006,677 | 4/1991 | Smith et al. | 200/61.89 |

FOREIGN PATENT DOCUMENTS

| | | |
|---|---|---|
| 7402173.1 | 7/1974 | Fed. Rep. of Germany . |
| 2848875 | 10/1978 | Fed. Rep. of Germany . |
| 8220251.6 | 7/1982 | Fed. Rep. of Germany . |
| 8802361.3 | 2/1988 | Fed. Rep. of Germany . |

*Primary Examiner*—J. R. Scott

*Attorney, Agent, or Firm*—R. A. Johnston

[57] ABSTRACT

A switch assembly having a sliding plunger type actuator with the actuator assembled in a separate housing portion and snap-locked to a housing portion having a plurality of switches pre-assembled, with the ends of the switch blade engaging the actuator upon assembly. The plunger is surrounded by a collar having a plurality of fingers. Upon insertion of the plunger and fingers in a mounting structure aperture and upon rotation of the switch assembly, the locking fingers are spread by cam action. The plunger is friction-detentedly telescoped in said actuator for adjustment of the free position thereof after installation.

6 Claims, 4 Drawing Sheets

SWITCH ASSEMBLY

BACKGROUND OF THE INVENTION

The present invention relates to electrical switches of a type mounted to a bracket or panel, and having an actuating plunger extending therethrough for being contacted by a user-movable member for effecting movement of the plunger, and actuation and deactuation of the switch. Switches of this type are typically employed for the brake light or stop lamp switch in motor vehicles where the plunger is held depressed by the vehicle's service brake pedal arm; and, the plunger is released upon movement of the brake pedal arm by the vehicle driver, causing a switch to energize the vehicle stop or brake lights.

In providing plunger actuated brake light switches for automotive vehicles, problems have been encountered in mounting the switch assembly for actuation by the vehicle brake pedal arm inasmuch as the at-rest, or unactuated position of the brake pedal arm is extremely difficult to predetermine with any degree of precision because the brake pedal is spring loaded against a resilient, typically elastomeric, limit stop. Thus, although the brake light switch assembly may be accurately located on a mounting bracket positioned adjacent the brake pedal arm, the variation from vehicle to vehicle in the position of the brake pedal arm at rest with respect to the switch mounting bracket requires that each brake light switch be adjustably mounted in order to permit calibration of the actuating point in the movement of the brake light switch plunger with respect to the at rest position of the brake pedal arm.

It has thus been desired to find a way or means of providing for mounting in mass production a plunger-actuated switch assembly for mounting with respect to a user-actuated member which has a variable at-rest position from assembly to assembly. In particular, it has been desired to find a way or means of positioning a vehicle brake light switch adjacent the brake pedal arm in a manner which eliminates the need to calibrate the mounting position of each vehicle switch with respect to the brake pedal arm at rest position for proper actuation of the switch plunger.

In a known plunger actuated switch employed in vehicles for switching on interior lights upon door opening, where the plunger is moved by the door frame, as described in FIGS. 1 and 2, a switch housing portion 10 has the movable plunger 12 extending therefrom with a plurality of ribs or convolutions 14 provided on the housing. A collar 16 is received over the housing, and has a rib 18 which engages the convolutions for permitting adjustable positioning of the collar on the housing.

The collar has an annular detent surface 18 provided about the outer surface thereof, and a movable annular locking member 20 received thereover and axially movable thereon. The locking member 20 has a plurality of circumferentially spaced axially extending curved fingers 22 provided thereon, which are radially deformable by the outer periphery of the collar 16 upon sliding movement of the locking member 20 with respect to the collar 16. In FIG. 1, the assembly is shown with the locking member 20 moved axially to the upwardmost position on the collar 16, wherein the fingers 22 move radially inwardly against the collar 16 by virtue of self-bias, thereby enabling the assembly to be inserted in an aperture 24 provided in a suitable mounting structure 26. In FIG. 2, the assembly is shown after installation, with the housing 12 and collar 16 moved upward, thereby camming the fingers 22 radially outwardly until an annular locking member is registered against the mounting structure 26; whereupon, the fingers 22 snap radially inwardly to engage the detent surface 18, thereby securing the assembly onto the mounting structure 26, as a result of the radially outward spreading of the fingers 22 over the aperture 24. In the application of the switch shown in FIGS. 1 and 2, the actuation point of the switch is not important, so long as the door movement is sufficient to permit the plunger to travel its full-stroke to effect switch actuation: thus, the mounting of the switch is not critical with respect to the door frame position.

It has, therefore, been desired to find a convenient way or means of rigidly mounting a plunger operated electrical switch on an apertured structure in high volume mass production for actuation by a user moveable member and to provide precise control of the switch actuation despite variation in the position of moveable member with respect to the mounting structure from one assembly to the next without requiring an adjustable switch mounting.

SUMMARY OF THE INVENTION

The present invention provides a unique and novel plunger operated switch assembly which is mountable upon an apertured mounting structure for actuation of the plunger by a user moveable member, such as a motor vehicle brake pedal arm. The switch assembly of the present invention is conveniently inserted and twist-locked into the mounting aperture by a collar rotatably positioned on the switch housing. The collar has fingers which are spread outwardly by cams on the switch housing upon relative rotation therebetween after insertion of the fingers through the aperture of the mounting structure. The plunger is connected to the internal switch actuator mechanism by detent means which enable the plunger to be moved relative to the actuator after assembly onto the mounting structure for adjusting the free position of the actuator correctly with respect to the moveable mounting member for providing proper calibration of the switch actuation point with respect to the user moveable member.

The switch of the present invention has a switching mechanism and contacts for plural circuits mounted in one portion of a housing with the moveable contact members having portions thereof extending outwardly from the housing portion. The internal actuating mechanism and plunger and collar of the switch which are mounted in a separate housing portion; and, the two housing portions are built up separately and then the movable contact member engaged in bayonet fashion with the internal actuating mechanism and the housing portions are snap-locked together for final assembly of the switch. The construction of the present switch enables assembly of the electrical switching components in one portion of the housing and separate assembly of the actuator and plunger mechanism in another portion of the housing and a quick connecting snap lock assembly of the two housing portions for providing a completed switch which is then readily insertable into an aperture on the desired mounting structure. The construction of the present switch assembly has been found particularly suitable for application as a motor vehicle stop lamp or brake light switch of the type wherein the plunger is actuated by user movement of the vehicle brake pedal arm.

DETAILED DESCRIPTION

Figure 1:
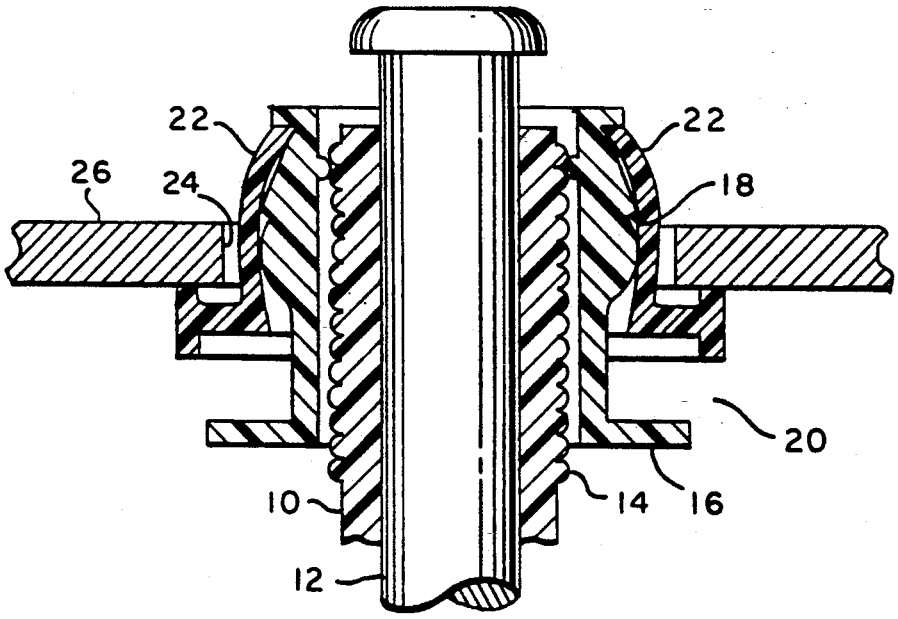
PRIOR ART FIG. 1
FIG. 1 is a cross-section of a mounting of a prior art switch assembly as initially inserted on a panel.
Figure 2:
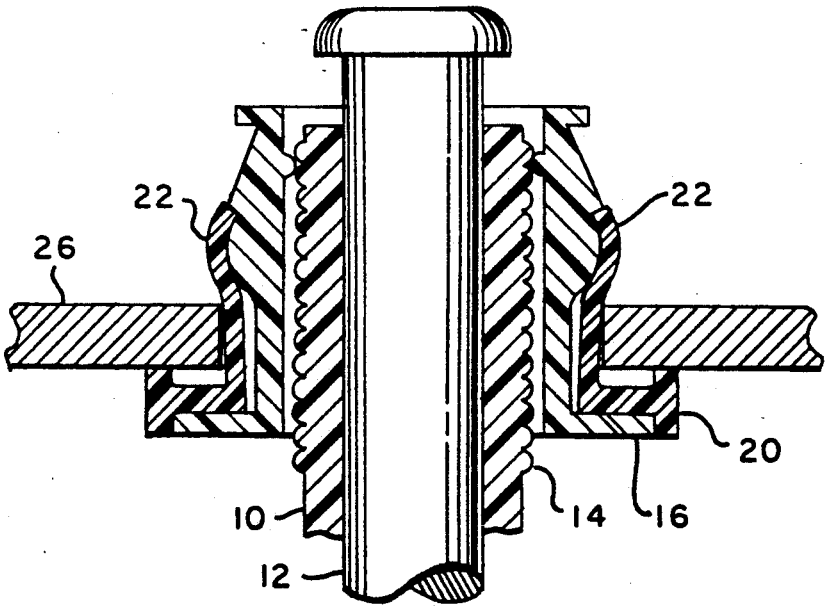
PRIOR ART FIG. 2
FIG. 2 is a view similar to FIG. 1, showing the prior art switch assembly fully installed.
Figure 3:
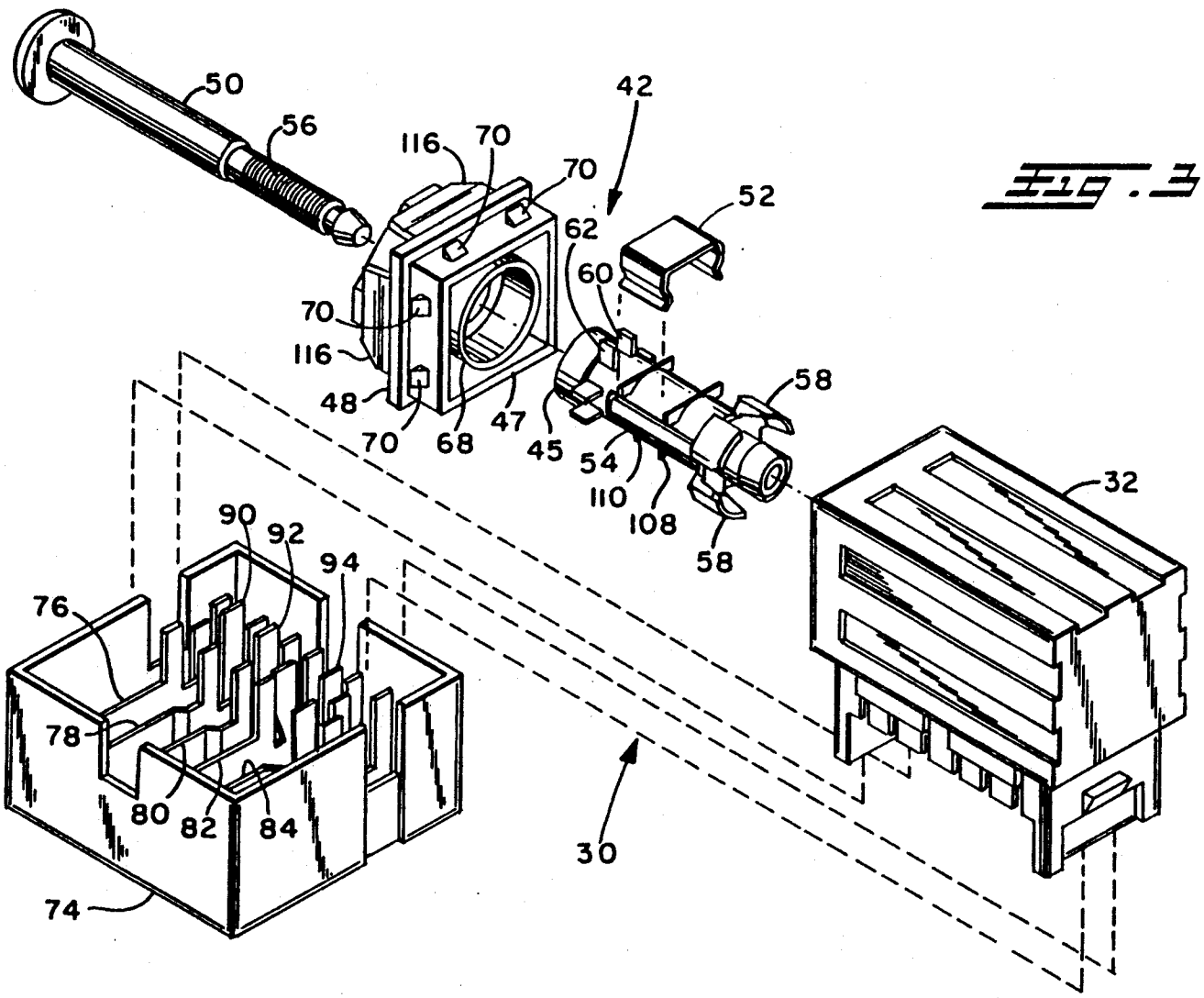
FIG. 3 is an exploded view of the switch assembly of the present invention.
Figure 4:
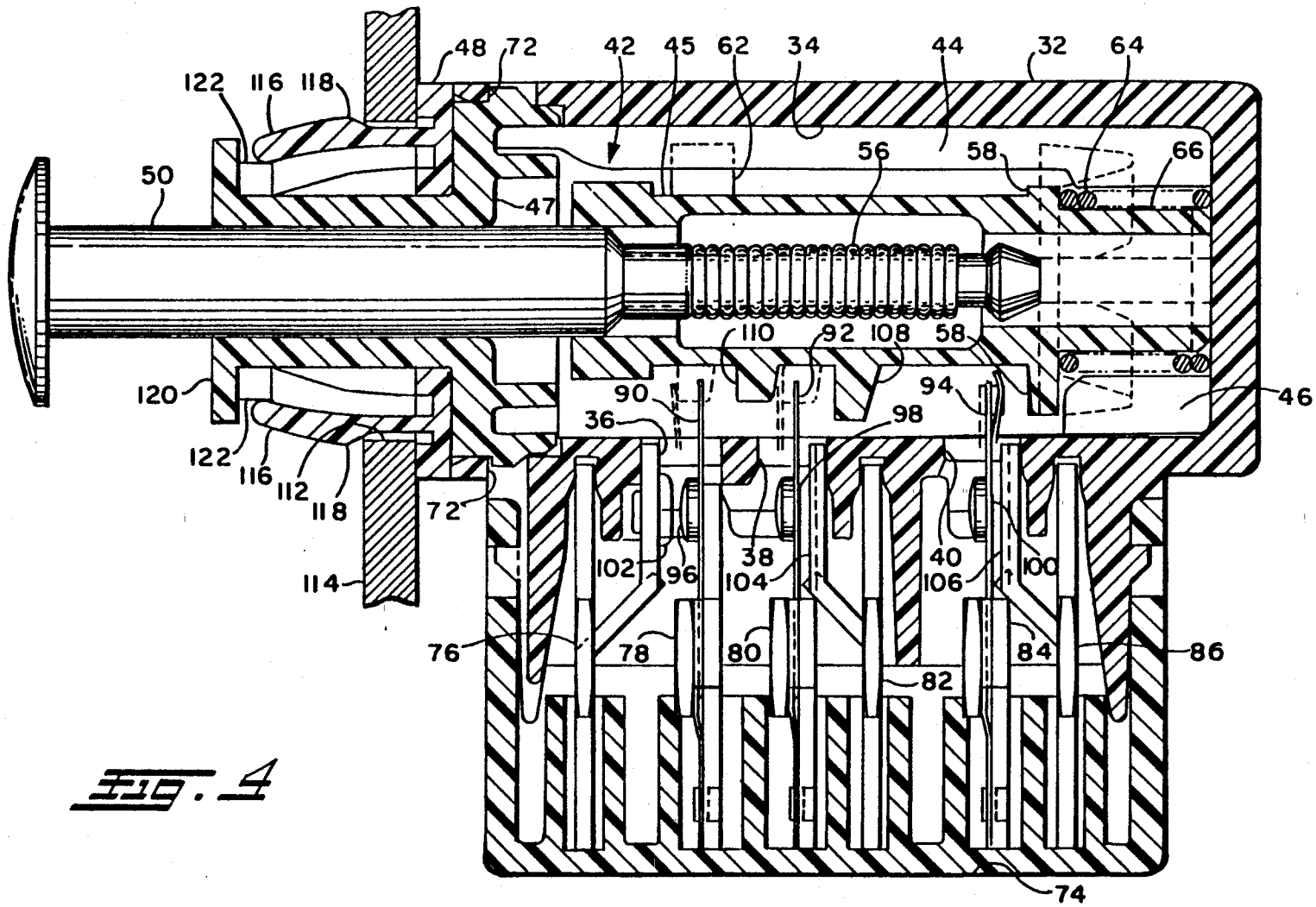
FIG. 4 is a cross-sectional view of the assembled switch assembly of FIG. 3.
Figure 5:
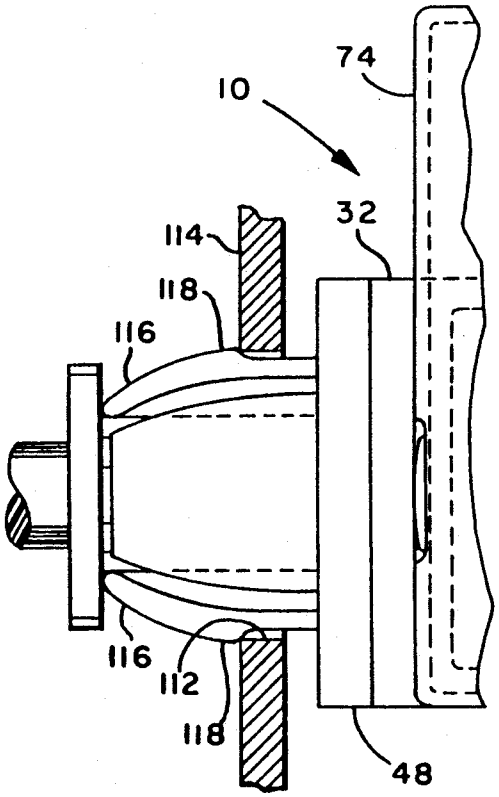
FIG. 5 is a bottom view of the switch of FIG. 4.

Referring to FIGS. 3, 4, and 5, the assembly of the present switch is indicated generally at 30 and comprises an actuator housing portion having a cavity or bore 34 provided therein for receiving the switch actuator mechanism therein. The housing portion 32 has a plurality of openings spaced along the bore 34 and indicated by reference numerals 36, 38 and 40 in FIG. 4 and 5. The bore 34 has a plurality of spaced ribs or flutes 44, 46 extending interiorly thereof for slidably guiding the actuator assembly 42 therein.

Referring to FIGS. 3 and 4, the actuator assembly 42 comprises a generally cylindrical tubular actuator member 45, a cap member 47 and a collar 48 rotatably mounted thereon and a plunger member 50 received in the actuator and adjustably secured thereto by clip 52.

The actuator 45 has a plurality of resilient diametrically opposed longitudinally extending strips 54 provided thereon which are resiliently deformed inwardly by clip 52 for frictionally engaging a plurality of convolutions 56 provided on the plunger 50 for providing a detent action to the adjustment of the plunger 50 on the actuator 45. The actuator 45 also has a plurality of guide spokes 58 provided on one end thereof slidably engaging ribs 44 and 46 with the ends of spokes 58 flanged to provide a generally cup-shaped configuration to the spokes. Additional pairs of spokes 60, 62 are provided near the opposite end of actuator 45. The spaces between the spokes 60, 62 and the spokes 58 are interdigitated by the guide ribs 44, 46 for providing guidance and positioning of the actuator 45 within the bore 34.

The end of the actuator member 45 having the spokes 58 thereon is biased in a direction outwardly of the bore by a compression spring 64 having one end registered against the spokes 58 and the opposite end registered against the inner wall of the housing portion 32. With reference to FIG. 4, the actuator 45 is shown fully depressed or moved to its limit position in a rightward direction with respect to housing 32; and, the spring 64 is in the fully compressed state. Pilot portion 66 is provided on the end of the actuator 45 which portion 66 is received interiorly of the spring 64 and the end of portion 66 serves as a stop for the actuator 45 contacting the wall of the housing portion 32.

Referring to FIGS. 3 and 4, the cap 47 has an annular flange 68 provided thereon which has the end of actuator 45 slidably received therein when the actuator is biased to its fully extended position, or to the extreme limit of its leftward travel. In this latter condition, the end of the actuator 45 registers against the undersurface of cap 47.

Cap 47 has a plurality of tapered lugs 70 provided about the periphery thereof which lugs inter-engage corresponding recesses 72 provided in the housing portion 32, which recesses are shown in FIG. 4. The cap 47 is thus snap-locked into the end of the housing portion 32 to retain the assembly thereon.

Referring to FIGS. 3, 4, and 5, a second housing portion 74 has a generally rectangular cup-shaped configuration, and has received therein a plurality of electrical connector terminals 76, 78, 80, 82, and 84 adapted for external bayonet connection thereto as, for example, by a wiring harness connector (not shown) inserted into the opening of the cup-shaped member. In this regard, it will be understood that the portion of the cup-shaped member having the members 76, 78, 80, 82, 84, and 86 extends transversely beyond the housing portion 32 in overhanging relationship therewith to permit the aforesaid bayonet connection.

A plurality of movable switch contact blades, each having an electrical contact thereon, are disposed in the housing portion 74, and are respectively associated with one of the terminals 76 through 86; and, the movable contact blades are denoted in the drawings respectively by the reference numerals 90, 92, and 94. The blades each have a movable contact thereon denoted respectively 96, 98, 100, each of which is disposed adjacent a stationary contact denoted respectively by reference numerals 102, 104, 106, for forming an electrical switch therebetween. Each of the blades 90, 92, 94, has the end thereof extending outwardly of the housing portion 74; and, upon attachment of the housing portion 74 to the actuator housing portion 32, the ends of the blades 90, 92, and 94 extend respectively through the apertures 36, 38, and 40 into to the bore 34 of actuator housing portion 32.

The actuator member 45 has a plurality of projections or lugs 108, 110 extending downwardly therefrom and located generally at the mid-length thereof.

In the fully-depressed position of the actuator shown in solid outline in FIG. 4, the lug 110 is disposed intermediate the ends of contact blades 90 and 92; the lug 108 is disposed between the ends of contact blades 92 and 94; and, one of the end spoke 58 is disposed adjacent the blade 94. In the fully depressed position of the actuator shown in FIG. 4, each of the blades 90, 92, 94 is in its free position, wherein switch blade 90 creates an open circuit between contacts 96 and 102; switch blade 92 has closed the circuit between contacts 98 and 104; and, switch blade 94 has closed the circuit between contacts 106 and 100. When the actuator 45 is moved to the fully extended or leftward position to contact the cap member 47, the lug 110 makes contact with switch blade 90 and closes contacts 96 and 102; the lug 94 makes contact with switch blade 92, and opens contacts 98 and 104; and, the spoke 58 contacts switch blade 94, thereby opening contacts 106 and 100.

Figure 6:
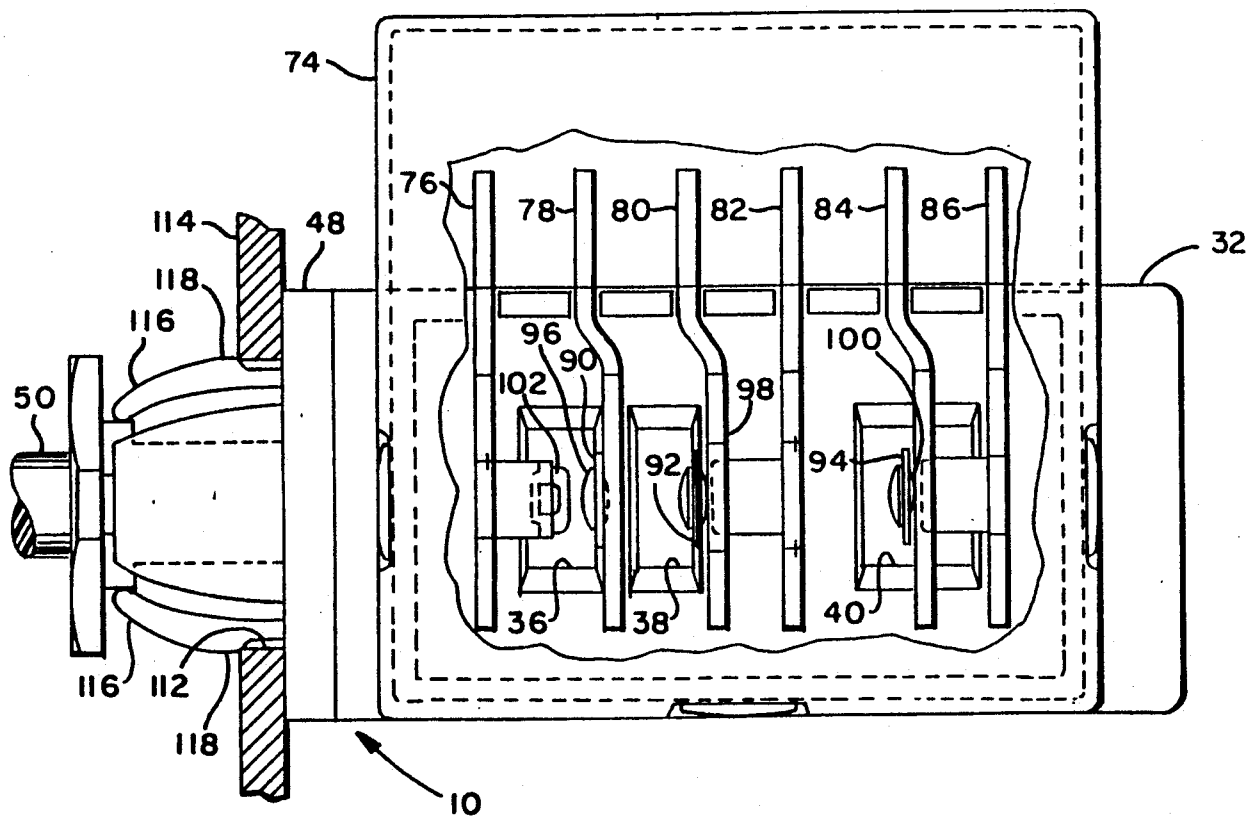
FIG. 6 is an enlarged detail of the switch of FIG. 3 as initially inserted into a panel.

Referring to FIGS. 4, 5, and 6, the switch assembly is shown as installed in an aperture 112 provided in a suitable mounting structure as, for example, panel or bracket 114.

Referring to FIG. 6, the assembly 10 is shown as partially inserted into the aperture 112, with the plurality of spaced fingers 116 extending from collar 48, each deflected inwardly by the camming action of the sides of aperture 112 against the lobes 118 formed on the outer surface of each of the fingers 116.

Referring to FIG. 5, the switch assembly 10 has been fully inserted into the mounting aperture 112 such that the axial surface of the collar 48 registers against the undersurface of the panel 114; and, the fingers 116 extend through the panel 114 such that the lobes 118 are disposed against the edge of the panel 114 opposite collar 48.

Referring to FIG. 4, the collar is assembled to the switch at approximately 30° rotation from normal alignment with the switch. When inserted into the panel, the collar is then in proper orientation and the switch assembly is at approximately 30° until the switch assembly is rotated to the locked position, with the collar remaining in a fixed position during the switch assembly rotation to the locked position.

The cam lugs 122 provided adjacent flange 120 on cap 46 have caused the ends of the fingers 116 to be spread outwardly. Spreading of fingers 116 causes lobes 118 to engage with the edge of the aperture 112 in the mounting structure 114 and retain the switch assembly secured to the structure 114. Thus, the switch assembly 10 is assembled to the mounting structure 114 by direct insertion through the aperture 112, and is securely locked thereto by a simple twist of the switch assembly 10 after insertion.

The user movable member (not shown) may then be moved against plunger 50 to cause actuator 45 to move rightwardly to its limit stop; and, further movement of plunger 50 is absorbed by detented movement of convolutions 56 on plunger 50 with respect to strips 54.

The present invention thus provides a unique and novel plunger actuated switch assembly which is economically constructed by assembling the plunger actuator mechanism in one housing portion, and the switching mechanism in another housing portion, and snap-locking the housing portions together to form a completed switch assembly. The plunger is then inserted through an aperture in the desired mounting structure, and a plurality of resilient fingers are spread by rotation of the switch assembly to retain the switch assembly in the mounting structure. The plunger may then be adjustably moved with respect to the internal actuator of the switch for positioning the plunger at a desired position with respect to the at-rest position of a user-operated member intended for service actuation of the switch. The switch assembly of the present invention finds particular application in vehicles as a brake pedal actuated stop light control switch.

Although the present invention has hereinabove been described with respect to the illustrated embodiments, it will be understood that the invention is capable of modification and variation, and is limited only by the scope of the following claims.

I claim:

1. A brake light switch assembly for mounting in an apertured structure comprising:

(a) actuator housing means;

(b) plunger means having certain portions thereof received for sliding movement in said housing means, said plunger means having external portions thereof extending outwardly from said actuator housing means, said plunger means defining a plurality of switch actuating surfaces spaced along said certain portions;

(c) said housing means defining mounting surfaces disposed about said external portions and adapted to be inserted in said apertured structure for positioning said plunger means thereon for movable contact with said external portions by a brake pedal arm;

(d) switch housing means;

(e) a plurality of electrical switches received in said switch housing means, with each of said switches having an actuating member extending therefrom, said switch housing means releasably attached to said actuator housing means by mutual engagement in a direction generally at right angles to the direction of movement of said plunger means with each of said switch actuating members positioned to be operatively contacted by one of said switch actuating surfaces upon movement of said plunger means in said actuator housing means.

2. The switch assembly defined in claim 1, wherein said plunger means is spring biased in a direction outwardly of said actuator housing means.

3. The switch assembly defined in claim 1, wherein each of said switch actuating member comprises the end of a switch contact blade.

4. The switch assembly defined in claim 1, wherein said plurality of switches include two normally closed switches and one normally open switch when said plunger means is depressed.

5. The switch assembly defined in claim 1, wherein said releasable attachment of said actuator housing means and said switch housing means includes a snap locking mechanism.

6. The switch assembly defined in claim 1, wherein said switch housing means includes an electrically isolated terminal for each of said plurality of switches, with said terminal adapted for connection to a plural wire harness connector.

* * * * *